US005349734A

United States Patent [19]

Poulsen et al.

[11] Patent Number: 5,349,734

[45] Date of Patent: Sep. 27, 1994

[54] TOOL FOR USE IN THE SEPARATION OF ELEMENTS IN A BUILDING SET

[75] Inventors: Ole V. Poulsen; Carsten Michaelsen; Kurt Jensen, all of Vejle, Denmark

[73] Assignee: Interlego A.G., Baar, Switzerland

[21] Appl. No.: 768,577

[22] PCT Filed: Mar. 19, 1990

[86] PCT No.: PCT/DK90/00076

§ 371 Date: Nov. 20, 1991

§ 102(e) Date: Nov. 20, 1991

[87] PCT Pub. No.: WO90/11112

PCT Pub. Date: Oct. 4, 1990

[30] Foreign Application Priority Data

Mar. 20, 1989 [DK] Denmark ..... 1352/89

[51] Int. Cl.[5] ..... B23P 19/04

[52] U.S. Cl. ..... 29/239; 29/267

[58] Field of Search ..... 294/12, 15, 92; 81/3.55; 29/267, 239; 254/131, 17

[56] References Cited

U.S. PATENT DOCUMENTS 3,656,375 4/1972 Reed et al. ..... 81/3.55
3,713,246 1/1973 Kilroy .
4,110,932 9/1978 Brass .
4,390,112 6/1983 Tysver ..... 81/3.55
4,522,088 6/1985 Berglund ..... 294/15
4,949,600 8/1990 Tricinella ..... 81/3.55

FOREIGN PATENT DOCUMENTS 3213120 11/1982 Fed. Rep. of Germany .
2031286 4/1980 United Kingdom .

*Primary Examiner*—Robert C. Watson
*Attorney, Agent, or Firm*—Kane, Dalsimer, Sullivan, Kurucz, Levy, Eisele and Richard

[57] ABSTRACT

A tool (20) for use in the separation of elements in a building set, said elements having a face provided with coupling means which have a wall part extending transversely to the face, and which are preferably disposed in parallel with a side edge, comprises a lever (25) and a gripper means. The gripper means is disposed at one end of the lever and comprises a first jaw area (21,23) intended to tightly engage the side edge of the element, and a second jaw area (22,24) intended to tightly engage the portion of the wall part of said coupling means which faces away from said side edge. The gripper means may moreover comprise complementary coupling means for at least some of said coupling means.

5 Claims, 2 Drawing Sheets

TOOL FOR USE IN THE SEPARATION OF ELEMENTS IN A BUILDING SET

The invention concerns a tool for use in the separation of elements in a building set. More particularly, it concerns a tool for use in the separation of elements in a building set of the type where the elements have a surface provided with coupling means in the form of projections or depressions.

When disassembling elements in a building set of the above-mentioned type it can often be a problem to separate the individual elements, in particular when they are low so that it is difficult to get a sufficiently good grip with the fingers. If individual elements are to be disassembled from a larger structure, it may moreover be difficult, if not impossible, to grip the elements without damaging other parts of the structure.

The object of the invention is accordingly to provide a tool which can be used for disassembling elements in a building set of the above-mentioned type so that the elements can easily be separated.

This object is achieved in that in one end of a lever the tool is provided with a gripper means for cooperation with a plurality of coupling means of the element and with one side edge of the element so that the element can be tilted loose by affecting the lever. The gripper means comprises a first jaw area which engages the side edge, while a second jaw area of the gripper means engages a portion of a wall part of the coupling means facing away from said side edge. When the lever is affected, the two jaw areas affect the element with a relatively great torque owing to their mutual horizontally as well as vertically displaced position, so that the element pivots around the lower boundary of the side edge.

The gripper means may be constructed in various ways, and, according to a preferred embodiment, it comprises at least one coupling means which is complementary to said coupling means and, in addition to increasing the friction between the gripper means and the element by tilting operations, also maintains the element in the gripper means after separation, so that the element can easily be moved out of large structures after separation.

Figure 1:
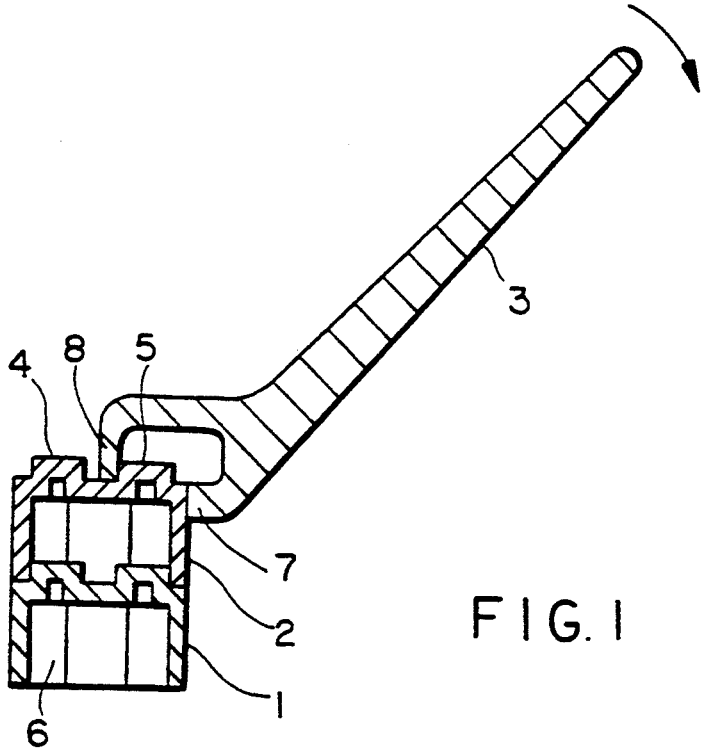
Figure 2:
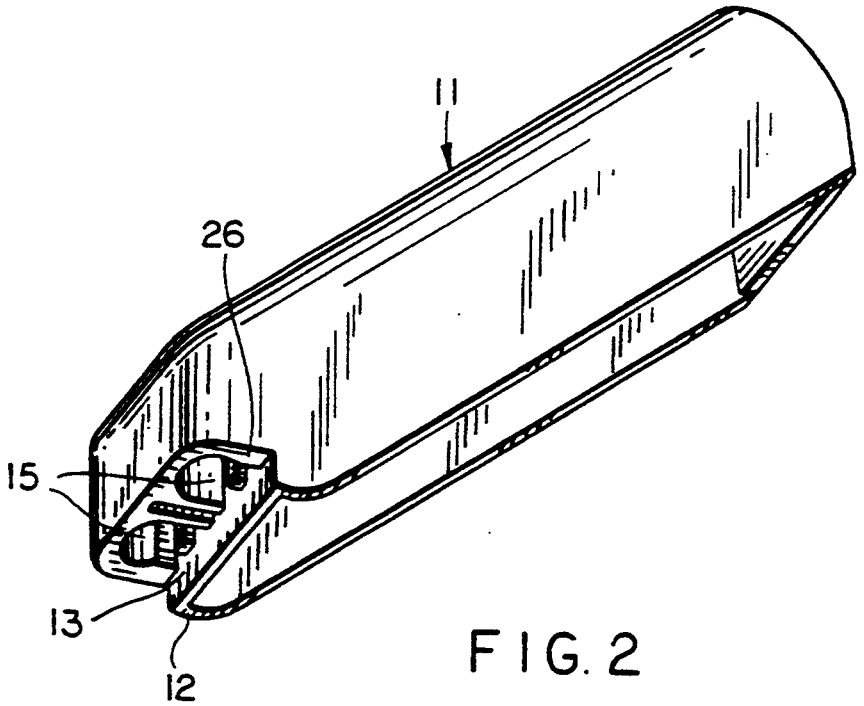
Figure 3:
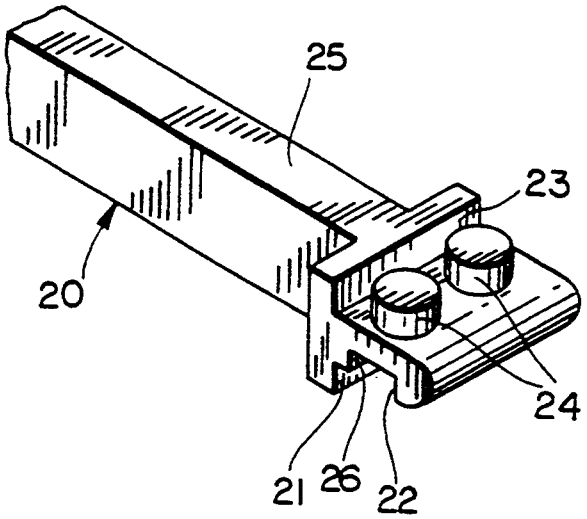

The invention will be described more fully below with reference to the drawing, in which FIG. 1 is a sectional view of the use of a tool according to the invention for separation of two elements, FIG. 2 shows in more detail the structure of the gripper means of the tool in a preferred embodiment, and FIG. 3 shows a tool according to another embodiment.

FIG. 1 is a sectional view of two joined toy elements 1 and 2 which may sometimes be difficult to separate, in particular for children. The surface of the toy elements is provided with coupling means in the form of coupling studs 4 and 5, while the underside is formed with a complementary recess 9. According to the invention, a tool 3 may be used for separating the elements 1 and 2. This tool comprises a gripper means in the form of a first jaw area 7 engaging the side edge of the building element 2, and a second law area 8 which engages a portion of a wall part of a coupling stud 5 facing away from the side edge. When the tool 3 activated in the direction of the arrow, the element 2 is affected by a torque so as to be tilted out of engagement with the element 1, the element 2 tilting around the lower boundary of the side edge. Since the first jaw area engages the side of the element 2, this torque may be relatively great even when the engagement is effected on the side edge part disposed near the surface. It will be appreciated that a similar tool useful for separating elements from below may be manufactured according to the invention. Such a tool will likewise cooperate with the side face of the element, while a jaw area cooperates with a coupling means on the underside of the elements.

FIG. 2 shows a tool 11 according to a preferred embodiment of the invention, and this tool is intended for cooperation with the upper side of a building element. The tool 11 is provided with holes 15 which fit on coupling studs on an element. The tool moreover comprises a first jaw area in the form of a projecting part 12 with a face 13 which is intended to tightly engage the vertical side face of a building element when the coupling studs of the building element are received in the holes 15. In this embodiment, the second jaw area of the tool is formed by the part of the holes 15 which faces away from the projecting part 12. Since coupling studs on the building element will be coupled with the tool 11 by virtue of the holes 15, this embodiment has the advantage that the friction between the tool and the coupling means of the building elements is increased by the tilting operation, and also that the building element is retained in the tool after separation.

It has been found that the height of the wall 7 does not have to be very great for the moment transferred by the tool jaw areas to the building elements to be sufficient for separation, so that the tool may be used even in connection with entirely flat building elements.

FIG. 3 shows a tool 20 which can be used for separating elements from above as well as from below. For separating elements from above it has on the underside a first jaw area 21 intended to tightly engage the side edge of the element, and a second jaw area 22 cooperating with coupling studs on the upper side of the element. For separation of elements from below the tool 20 is on the upper side provided with a first jaw area 23 intended to tightly engage the side edge of the element, and a second jaw area, here in the form of two coupling studs 24 cooperating with the complementary coupling means on the underside of the element. It is evident to a skilled person that such a tool may be constructed in numerous ways. The two different gripping means, which are intended to separate elements from above and from below, respectively, can of course be placed arbitrarily with respect to each other, e.g. at their respective ends of the lever 25. The second jaw area 24 on the upper side of the tool 20 can of course nave other forms than the shown one, if only the jaw area can tightly engage the complementary coupling means on the underside of the elements.

We claim:

1. A tool for use in the separation of elements of a toy building set, said elements having a top face provided with coupling means in the form of one of the type consisting of projections and the type consisting of depressions and having a wall part extending transversely to said top face, said elements further having side edges and said coupling means being disposed parallel to a side edge of said elements; said tool comprising:

a lever;

gripper means disposed at one end of said lever, said gripper means having first and second engagement faces, said first face being provided with coupling means of one of said depression and projection types configured to respectively engage one of the projection and depression types of coupling means of one of said elements and said second face being configured to engage a side edge of said one of said elements when said first face engages said one of the types of coupling means of said top face of said one of said elements.

2. A tool in accordance with claim 1 wherein said first engagement face defines a cavity for receiving therein at least one projection of said element coupling means.

3. A tool in accordance with claim 1 further comprising second gripper means disposed on said lever, said second gripper means including a first engagement face configured to engage the other type of coupling means.

4. A tool in accordance with claim 3 wherein said second gripper means is disposed at said one end of said lever opposite to said gripper means.

5. A tool in accordance with claim 1 wherein said first engagement face defines a projection for engaging one depression of said element coupling means.

* * * * *